United States Patent [19]

Baba et al.

[11] Patent Number: 4,555,012

[45] Date of Patent: Nov. 26, 1985

[54] METHOD AND DEVICE FOR SEPARATING AND CONNECTING TRANSFER BAR OF THREE UPRIGHT TYPE TRANSFER PRESS

[75] Inventors: Kiyokazu Baba, Komatsu; Kenji Nishida, Matsuto, both of Japan

[73] Assignee: Kabushiki Kaisha Komatsu Seisakusho, Tokyo, Japan

[21] Appl. No.: 559,553

[22] Filed: Dec. 8, 1983

[30] Foreign Application Priority Data

Dec. 10, 1982 [JP] Japan ..... 57-215542
Dec. 10, 1982 [JP] Japan ..... 57-185956

[51] Int. Cl.[4] ..... B65G 25/00; B65G 37/00

[52] U.S. Cl. ..... 198/621; 414/749; 414/786

[58] Field of Search ..... 414/749, 750, 751; 198/621; 72/774, 405, 422

[56] References Cited

U.S. PATENT DOCUMENTS 4,503,969 3/1985 Baba ..... 414/751 X

FOREIGN PATENT DOCUMENTS 108075 8/1979 Japan ..... 198/621

*Primary Examiner*—Joseph E. Valenza
*Assistant Examiner*—Stuart J. Millman
*Attorney, Agent, or Firm*—Armstrong, Nikaido Marmelstein & Kubovcik

[57] ABSTRACT

A method for separating and connecting a pair of transfer bars of a three-upright type transfer press, each transfer bar being dividable into five bar pieces, that is, an inlet side bar piece, first and second central bar pieces respectively positioned above first and second movable bolsters, an intermediate bar piece positioned between the central bar pieces and an outlet side bar piece, comprises separating at a time the bar pieces from one another by simultaneously moving them on both sides opposite to each other while locking the intermediate bar piece and while supporting the central bar pieces on the movable bolsters, respectively, and connecting them to one another by a sequence reverse to the separating sequence. Further, this invention relates to a device for practicing the method.

3 Claims, 18 Drawing Figures

METHOD AND DEVICE FOR SEPARATING AND CONNECTING TRANSFER BAR OF THREE UPRIGHT TYPE TRANSFER PRESS

BACKGROUND OF THE INVENTION

1. Field of the Invention

The present invention relates to a three-upright type transfer press, and more particularly to a method for separating and connecting a transfer bar capable of being separated into five bar pieces for use in the three-upright type transfer press and a device for practicing the method.

2. Description of the Prior Art

In conventional three-upright type presses having first and second movable bolsters, each of a pair of transfer bars is separated into five bar pieces, that is, an inlet side bar piece, first and second central bar pieces positioned above the bolsters, an intermediate bar piece positioned between the centeral bar pieces and an outlet side bar piece. The central bar pieces are capable of being taken in and out of the press body together with the movable bolsters, while the remaining bar pieces are let stand by between uprights.

The conventional separating sequence at the time of die change and connecting sequence after die change for the transfer bar constructed as above are as follows. Upon starting of die change, the transfer bar is moved to the outlet side of a workpiece. Then, the second movable bolster located on the outlet side is raised to support the second central bar piece positioned thereabove. In this state, the intermediate bar piece and the outlet side bar piece respectively connected to the left and right ends of the second central bar piece are separated from the second central bar piece. Thereafter, the first movable bolster is raised to support the first central bar piece positioned thereabove, and in this state the inlet side bar piece and the intermediate bar piece respectively connected to the left and right ends of the first central bar piece are separated from the first central bar piece. Thus, all the five bar pieces which constitute the transfer bar are separated from one another. In this separated state, the first and second movable bolsters respectively carrying thereon the first and second central bar pieces are drawn out from the press body and die change is performed. After the loading of a new die onto each movable bolster is completed, the movable bolsters are again pushed into the press body, and then the operation for connecting the five bar pieces is performed in accordance with the sequence reverse to that of the separating operation described above.

In the above-described conventional method, the two movable bolsters are raised successively, and the separating or connecting sequence is repeated at every rise of each movable bolster, thus requiring much time for the separation and connection of the transfer bar and thus resulting in deterioration of the working efficiency. For example, even when changing only the die on the first movable bolster, all of the foregoing separating and connecting sequences must be followed.

SUMMARY OF THE INVENTION

The present invention has been accomplished for eliminating the above-mentioned inconvenience. It is the first aspect thereof to provide a method for separating and connecting a transfer bar of a three-upright type transfer press, capable of raising first and second movable bolsters at a time while temporarily fixing a centrally positioned intermediate bar piece of the transfer bar placed in a separating position, then separating the transfer bar into five bar pieces at a time and also capable of connecting the separated bar pieces into the transfer bar in accordance with the reverse sequence, thereby permitting die change efficiently in a short time.

It is another aspect of the present invention to provide a device for practicing the above method.

In order to attain the above-mentioned first aspect of the present invention, there is provided according to the invention a method for separating and connecting a transfer bar of a three-upright type transfer press having a pair of transfer bars each capable of being separated into five bar pieces, that is, an inlet side bar piece, first and second central bar pieces respectively positioned above first and second movable bolsters, an intermediate bar piece positioned between the central bar pieces and an outlet side bar piece, which method involves fixing the intermediate bar piece temporarily to a central upright of the press body; at the temporarily to a central upright of the press body; at the same time, raising the first and second movable bolsters at a time to support the first and second central bar pieces so that the first and second central bar pieces are respectively movable by a predetermined distance longitudinally outwards thereof; separating all the bar pieces at a time by simultaneously moving the first central bar piece positioned on an inlet side relative to the intermediate bar piece as well as the inlet side bar piece to the inlet side and the second central bar piece positioned on an outlet side relative to the intermediate bar piece as well as the outlet side bar piece to the outlet side; and, after die change, connecting the bar pieces simultaneously in a sequence reverse to the above separating sequence.

In order to attain the foregoing second aspect of the present invention, there is provided according to the present invention a device for separating a transfer bar of a three-upright type transfer press having first and second movable bolsters and a set of transfer bars each capable of being separated into five bar pieces, that is, an inlet side bar piece, first and second central bar pieces respectively positioned above the first and second movable bolsters, an intermediate bar piece positioned between the central bar pieces and an outlet bar piece, characterized by comprising a locking mechanism for temporarily locking the intermediate bar piece to a central upright of the transfer press body; a support means for supporting the first and second central bar pieces respectively on the first and second movable bolsters so that the first and second bar pieces are respectively movable by a predetermined distance longitudinally outwards thereof; a first separating means for separating the first and second central bar pieces from the intermediate bar piece positioned therebetween; and a second separating means for separating the inlet and outlet side bar pieces respectively from the first and second central bar pieces, the second separating means being adapted to operate in synchronism with the first separating means.

According to the present invention, there is further provided a device of the above construction for separating a transfer bar of a three-upright type transfer press, wherein the first separating means comprises a pair of base plates mounted transversely in spaced relation to each other on the side of the central upright facing the transfer bar; two pairs of guide rails parallel to the transfer bar, each pair being fixed to each base plate at one side end portion of the latter; a pair of slide plates disposed movably along the guide rails; a pair of pushers pivotably supported substantially centrally on the slide plates; a pair of slide plate actuating cylinder means each pivotally secured at a base end portion thereof to the other side end portion of each base plate through a bracket and provided at the other end portion thereof with a piston rod which is pivoted to the slide plate; two pairs of cam plates mounted on side faces of the two pairs of guide rails in parallel with the transfer bars; urging means for pushing one end of each of the paired pushers continually against the cam surfaces of the paired cam plates to pivot the pusher so that the other end of the pusher moves away from the surface of each slide plate as the paired slide plates slide away from each other; and a pair of blocks respectively fixed to side end portions of the first and second central bar pieces facing the central upright on the side of the intermediate bar piece, the paired blocks being adapted to come into engagement with the said other ends of the paired pushers when the slide plates slide away from each other.

The above and many other advantages, features and additional aspects of the present invention will become manifest to those versed in the art upon making reference to the following detailed description and accompanying drawings in which preferred structural embodiments incorporating the principles of the present invention are shown by way of illustrative example.

DETAILED DESCRIPTION OF THE INVENTION

Figure 1A:
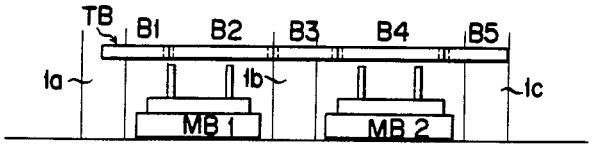
PRIOR ART FIG.1(A)
FIGS. 1(*A*)–1(*I*) is a schematic explanatory view showing a conventional separating and connecting sequence for a transfer bar of a three-upright type transfer press.
Figure 1B:
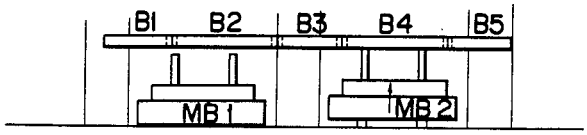
Figure 1C:
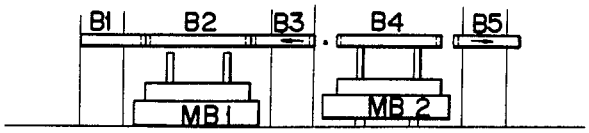
Figure 1D:
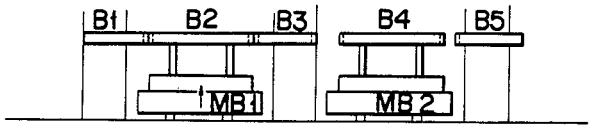
Figure 1E:
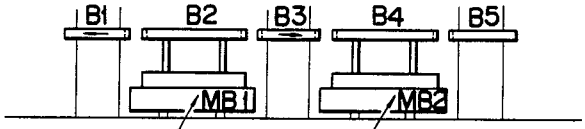
Figure 1F:
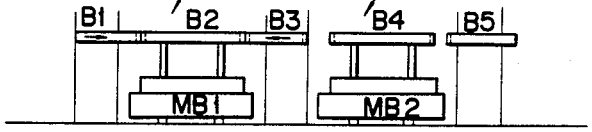
Figure 1G:
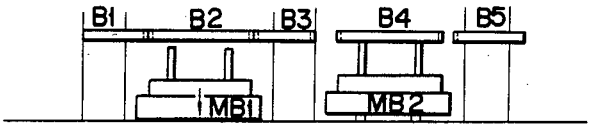
Figure 1H:
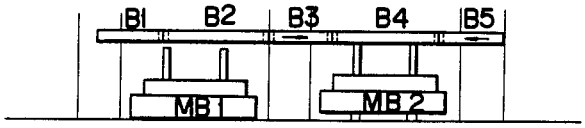
Figure 1I:
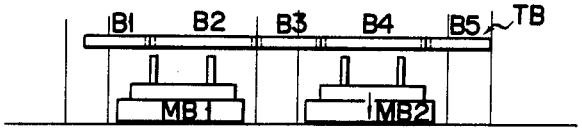
Figure 2A:
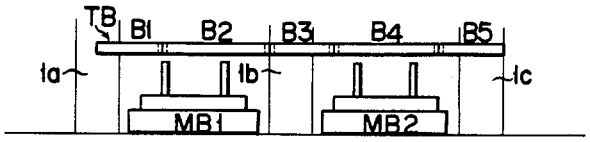
FIGS. 2(*A*)–2(*E*) is a schematic explanatory view showing a separating and connecting sequence in the present invention for a transfer bar of a three-upright type transfer press.
Figure 2B:
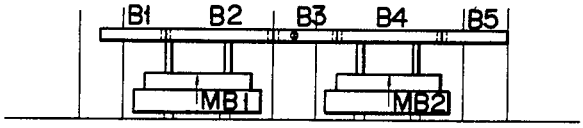
Figure 2C:
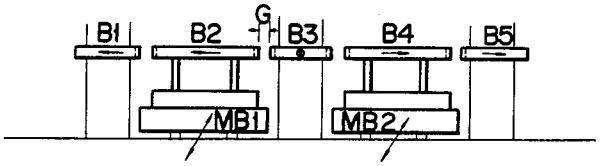
Figure 2D:
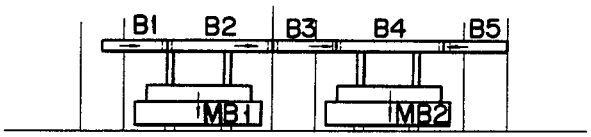
Figure 2E:
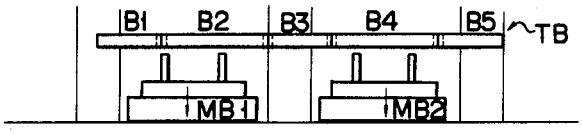

The transfer bar separating and connecting method of the present invention in a three-upright type transfer press will be described hereinunder with reference to FIGS. 1(*A*)–1(*I*) and 2(*A*)–2(*E*). First, reference will be made to the conventional method illustrated in FIGS. 1(*A*)–1(*I*) by way of comparison with the method of the present invention illustrated in FIGS. 2(*A*)–2(*E*).

In a three-upright type transfer press having three uprights 1*a*, 1*b* and 1*c* in a front view of the press body and two movable bolsters MB1 and MB2 each disposed therebetween, a transfer bar TB is capable of being divided into five bar pieces, that is, first and second central bar pieces B2 and B4 respectively positioned above the first and second movable bolsters, an intermediate bar piece B3 positioned therebetween, and inlet and outlet side bar pieces B1 and B5 respectively positioned outside the first and second central bar pieces. At the time of die change, the first and second central bar pieces can be taken in and out of the press body together with the movable bolsters which support them, while the remaining bar pieces are let stand by within the press body.

The conventional separating and connection of the transfer bar TB are performed in the following sequence. First, upon starting of die change the transfer bar TB is moved to a separating position on an outlet side (right-hand side in the figure) as shown in FIG. 1(*A*). Then, the second movable bolster MB2 is raised to support thereon the second central bar piece B4 as shown in FIG. 1(*B*). In this state, the bar pieces B1, B2 and B3 are moved to the inlet side, while the outlet side bar piece B5 is moved to the outlet side simultaneously, whereby the second central bar piece B4 is separated as shown in FIG. 1(*C*). Thereafter, the first movable bolster MB1 is raised to support thereon the first central bar piece B2 as shown in FIG. 1(*D*). In this state, the inlet side bar piece B1 and the intermediate bar piece B3 are simultaneously moved to the inlet and outlet sides, respectively, whereby the first central bar piece B2 is separated as shown in FIG. 1(*E*). In this state shown in FIG. 1(*E*), the first and second movable bolsters MB1 and MB2 are drawn out of the press body together with the first and second central bar pieces B2 and B4 respectively supported thereon, and die change is performed. After completion of die change, the first and second movable bolsters MB1 and MB2 respectively supporting thereon the first and second central bar pieces B2 and B4 are pushed into the press body, and the connection of the transfer bar TB is performed in the sequence reverse to the above separating sequence.

On the other hand, the separating and connecting sequences in the present invention are as follows. Reference is here made to FIGS. 2(*A*)–2(*E*), in which components common to FIGS. 1(*A*)–1(*I*) are indicated at the same reference marks or numerals. Upon starting of die change the transfer bar TB is set to the separating position as shown in FIG. 2(*A*). Then, the intermediate bar piece B3 is fixed to the central upright 1b of the press body by a suitable locking means, for example, by using a lock pin. At the same time, the first and second movable bolsters MB1 and MB2 are raised together to support the first and second central bar pieces B2 and B4 respectively simultaneously as shown in FIG. 2(*B*). In this state, the inlet side bar piece B1 and the first central bar piece B2 are moved toward the inlet side, and at the same time the outlet side bar piece B5 and the second central bar piece B4 are moved toward the outlet side, as shown in FIG. 2(*C*). At this time, the amount of movement of the inlet side bar piece B1 and that of the outlet side bar piece B5 are respectively made approximately twice the amount of movement G of each of the first and second central bar pieces B2 and B4 so that a gap G is present between adjacent bar pieces. In this way, the separation of the transfer bar TB is effected, and in this state the first and second movable bolsters MB1 and MB2 respectively supporting the first and second central bar pieces B2 and B4 are drawn out from the press body for die change. After completion of die change, the first and second movable bolsters MB1 and MB2 are pushed into the press body together with the first and second central bar pieces supported thereon, and the connection of the transfer bar TB is effected in the sequence reverse to the above-mentioned separating sequence, as shown in FIGS. 2(*D*) and 2(*E*). Lastly, the intermediate bar piece B3 is unlocked.

According to the separating and connecting method of the present invention, as will be apparent from the above description, the sequence of operations is reduced to about half and the time required for the operations is greatly shortened as compared with the conventional method. Further, in the conventional method, for example, even in the case of die change of only the first movable bolster MB1, it is necessary to follow the entire sequence mentioned above. On the other hand, according to the method of the present invention, it is possible to separate only the central bar piece supported on the movable bolster on the side requiring die change.

The transfer bar separating device of the present invention will be described below with reference to FIGS. 3 to 6.

Figure 3:
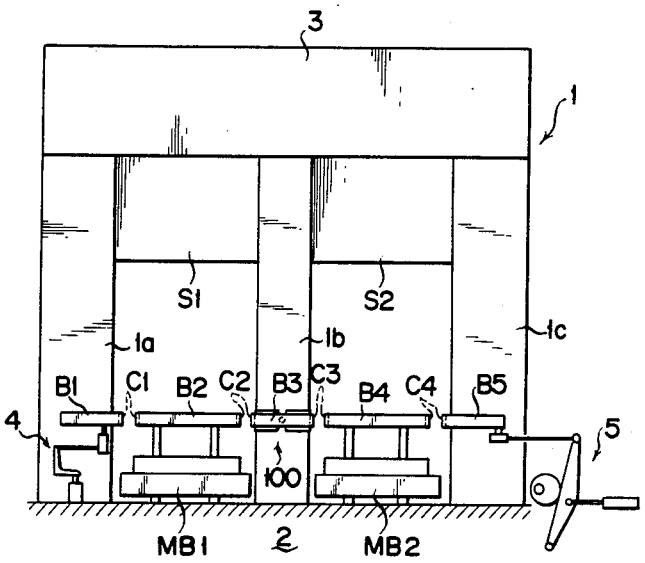
FIG. 3 is a schematic longitudinal front view of a three-upright type transfer press having a transfer bar separating device according to the present invention.

FIG. 3 is a schematic longitudinal front view of a three-upright type transfer press provided with the transfer bar separating device of the present invention, in which the reference numeral 1 denotes a three-upright type transfer press which is composed of uprights 1*a*, 1*b*and 1*c*, a bed 2 and a crown 3. Two movable bolsters MB1 and MB2 are mounted between adjacent uprights on the bed 2 so as to be movable into and out of the press body. The marks S1 and S2 denote mating slides respectively of the dies on the movable bolsters MB1 and MB2, and the marks B1 and B5 denote bar pieces which constitute a transfer bar TB used for carrying in (or carrying out) of a workpiece onto (or from) the two movable bolsters. In the illustrated state, the transfer bar TB is separated into the bar pieces. For function as a transfer bar, all the bar pieces B1 to B5 are connected together through connectors C1 to C4.

The transfer bar separating device for die change is composed of a transfer bar moving mechanism 4 mounted on the inlet side, a transfer bar feed mechanism 5 mounted on the outlet side and a central separating unit 100 attached to the central upright 1*b*. These constituent members are hydraulically operated in synchronism with one another.

The transfer bar moving mechanism 4 and the transfer bar feed mechanism 5 are of known constructions, so explanations thereon are here omitted. The central separating unit 100 will be described in detail hereinunder with reference to FIGS. 4 to 6.

Transversely extending two base plates 6 are fixed in spaced relation to each other to the side face of the central upright 1*b* facing the transfer bar TB. The devices mounted on the base plates 6 are symmetrical with respect to a plane which passes the central vertical axis of the central upright 1*b* and which intersects perpendicularly to the transfer bar, so for avoiding overlap, the following description is provided with regard to only the left-hand base plate 6 in the figures.

On the side portion of the base plate 6 extending from substantially the center to one (outside) end portion there are fixedly mounted a pair of upper and lower guide rails 7 extending in parallel with the transfer bar TB, and between the guide rails 7 is disposed a slide plate 8 movably along the guide rails. On the side of the slide plate 8 are integrally formed a pair of projections 8*a* and 8*b* in transversely spaced relation to each other in substantially vertically central positions. To one projection 8*a* is pivotally secured a piston rod 9*a* of a slide plate actuating cylinder 9 which is pivoted at its base end portion to a bracket 6*a* projecting from a vertically central part of the other side (inside) of the base plate 6. To the other projection 8*b* is connected an intermediate portion of a pusher 10 pivotally through a pin 11. On one end side of the pusher 10 is mounted a sleeve 10*a* in a direction perpendicular thereto, and a rotating shaft 13 provided at both end portions thereof with rollers 12 is supported in the sleeve 10*2*. To the sleeve 10*a* anchored one ends of tension springs 14 other ends of which are anchored onto the slide plate 8. By virtue of the tension springs 14, the rollers 12 are held in pressure contact with cam surfaces 15*a* of cam plates 15 erected on the guide rails 7. The cam surface 15*a* of the cam plate 15 is high on the actuating cylinder 9 side and low on the opposite side. These high and low portions are contiguous to each other through an inclined cam surface 15*b*. As the rollers 12 roll on the cam surfaces 15*a* and 15*b*, the fore end portion of the pusher 10 stands up from a stand-by position shown in solid line FIG. 5 to an urging position shown in phantom to abut a block 16 projecting from the side of the first central bar piece B2 which faces the central upright 1*b*.

On the other hand, at a substantially central part of the central upright 1*b* is mounted a locking mechanism 20 in a position between the base end portions of right and left actuating cylinders 9. The locking mechansim 20 is for retaining the intermediate bar piece B3 to the central upright 1*b* when separating the first and second central bar pieces B2 and B4 from the intermediate bar piece B3. It has a locking cylinder 21 for moving a lock pin 22 toward the intermediate bar piece B3. The lock pin 22 is mounted at the tip end of the locking cylinder 21, and when projected in a direction perpendicular to the intermediate bar piece B3, it is fitted in a recess 22*a* formed in the side of the intermediate bar piece B3.

Figure 4:
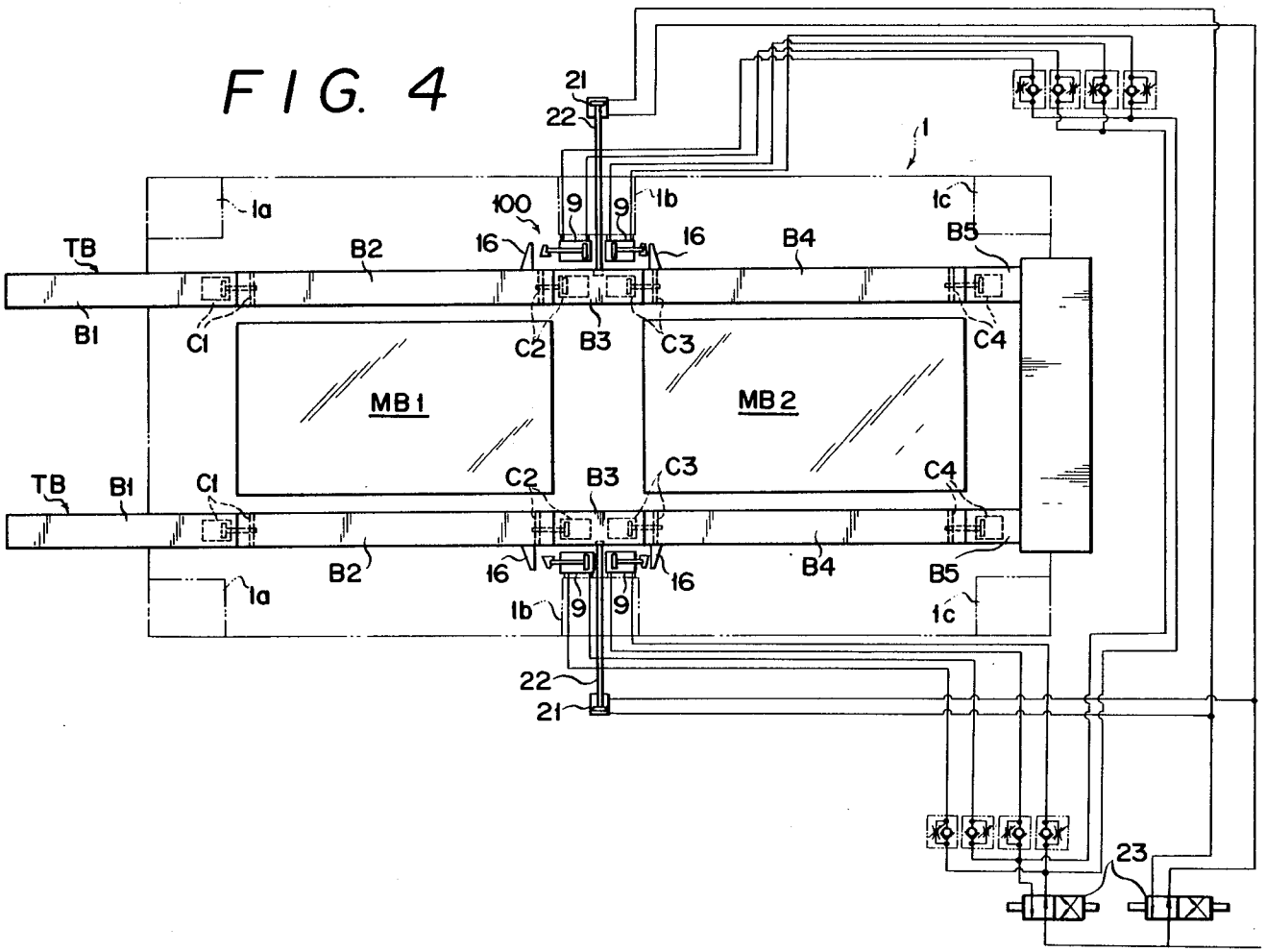
FIG. 4 is a schematic plan view showing an embodiment of the transfer bar separating device of the invention.
Figure 5:
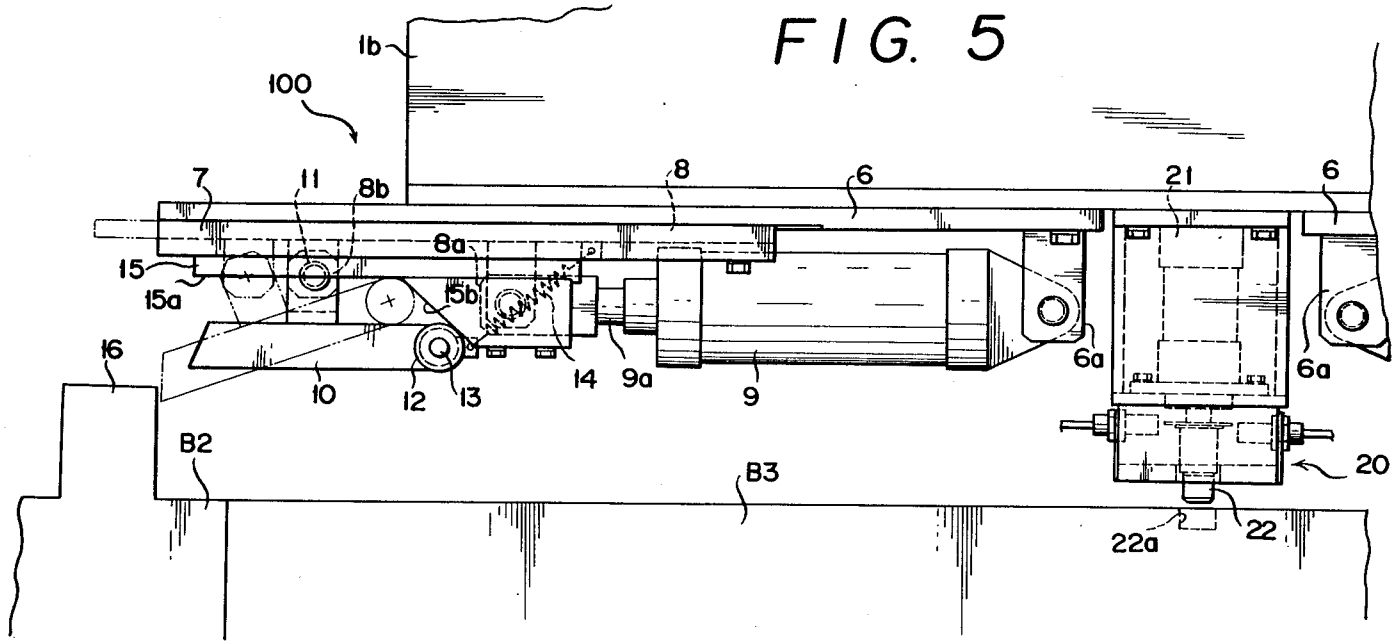
FIG. 5 is a partially cut-away and partially enlarged plan view in the embodiment of the transfer bar separating device of the invention.
Figure 6:
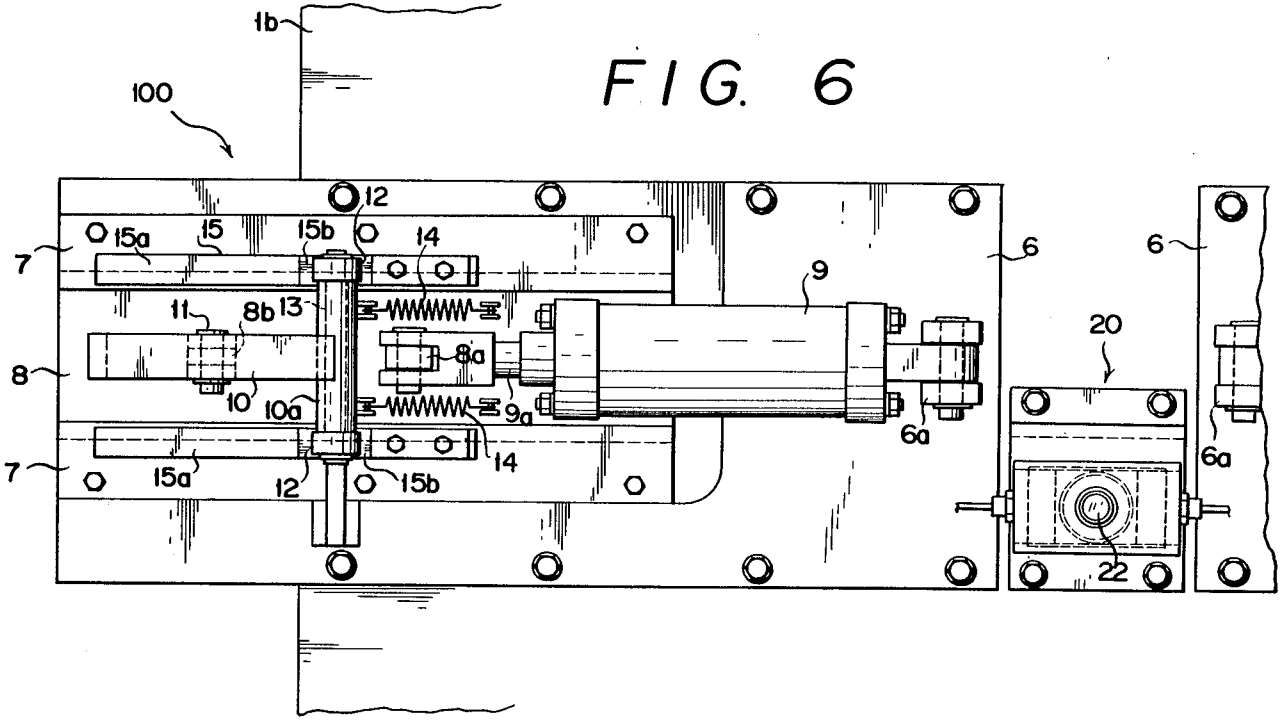
FIG. 6 is a partially cut-away and partially enlarged longitudinal front view in the embodiment of the transfer bar separating device of the invention.

In FIG. 4, the reference numeral 23 denotes a solenoid valve disposed between each actuating cylinder 9 and a pressure source (not shown). The cylinders 9 can be operated by an ON/OFF control of the solenoid valves 23.

In the present invention, as set forth hereinabove, when separating the transfer bar for die change, the first and second movable bolsters MB1 and MB2 are raised simultaneously to support the first and second central bar pieces B2 and B4 from below so that the first and second central bar pieces B2, B4 are respectively movable by a predetermined distance G longitudinally outwards thereof. In this state, the tip end of the lock pin 22 is inserted in the recess 22*a* of the intermediate bar piece B3 by means of the locking cylinder 21 of the locking mechanism 20 to lock the intermediate bar piece B3. If in this state a pressure oil is fed to the bottom side of each actuating cylinder 9, the slide plate 9 moves toward the first and second central bar pieces B2 and B4, so that the rollers 12 at the base end portion of the pusher 10 supported by the slide plate 8 slide down along the inclined cam surfaces 15*b* of the cams 15, thus causing the fore end portions of the pushers 10 to rise to the respective urging positions and abut the blocks 16 of the first and second bar pieces B2 and B4. By further advancing the slide plate 8 in this state, the first and second central bar pieces B2 and B4 can be separated simultaneously from the intermediate bar piece B3 locked by the locking mechanism 20. It goes without saying that the connectors between adjacent bar portions are all removed during the operation for separating the transfer bar TB.

What is claimed is:

1. A method for separating and connecting a transfer bar of a three-upright type transfer press having a set of transfer bars each capable of being separated into five bar pieces, that is, an inlet side bar piece, first and second central bar pieces respectively positioned above first and second movable bolsters, an intermediate bar piece positioned between the central bar pieces and an outlet side bar piece, which method comprises fixing said intermediate bar piece temporarily to a central upright of the press body; at the same time, raising the first and second movable bolsters at a time to support said first and second central bar pieces so that the first and second central bar pieces are respectively movable by a predetermined distance longitudinally outwards thereof; separating all the bar pieces at a time by simultaneously moving the first central bar piece positioned on an inlet side relative to the intermediate bar piece as well as the inlet bar piece to the inlet side and the second central bar piece positioned on an outlet side relative to the intermediate bar piece as well as the outlet side bar piece to the outlet side; and, after die change, connecting the bar pieces simultaneously in a sequence reverse to the above separating sequence.

2. A device for separating a transfer bar of a three-upright type transfer press having first and second movable bolsters and a set of transfer bars each capable of being separated into five bar pieces, that is, an inlet side bar piece, first and second central bar pieces respectively positioned above said first and second movable bolsters, an intermediate bar piece positioned between the central bar pieces and an outlet bar piece, characterized by comprising a locking mechanism for temporarily locking said intermediate bar piece to a central upright of the transfer press body; a support means for supporting said first and second central bar pieces respectively on said first and second movable bolsters so that the first and second bar pieces are respectively movable a predetermined distance longitudinally outwards thereof; a first separating means for separating said first and second central bar pieces from said intermediate bar piece positioned therebetween; and a second separating means for separating said inlet and outlet side bar pieces respectively from said first and second central bar pieces, said second separating means being adapted to operate in synchronism with said first separating means.

3. A device for separating a transfer bar of a three-upright type transfer press according to claim 2, wherein said first separating means comprises a pair of base plates mounted transversely in spaced relation to each other on the side of said central upright facing the transfer bar; two pairs of guide rails parallel to the transfer bar, each pair being fixed to each said base plate at one side end portion of the latter; a pair of slide plates disposed movably along said guide rails; a pair of pushers pivotably supported substantially centrally on the slide plates; a pair of side plate actuating cylinder means each pivotally secured at a base end portion thereof to the other side end portion of each said base plate through a bracket and provided at the other end portion thereof with a piston rod which is pivoted to said slide plate; two pairs of cam plates mounted on side faces of said two pairs of guide rails in parallel with the transfer bars; urging means for pushing one end of each of said paired pushers continually against the cam surfaces of said paired cam plates to pivot the pusher so that the other end of the pusher moves away from the surface of each said slide plate as the paired slide plates slide away from each other; and a pair of blocks respectively fixed to side end portions of said first and second central bar pieces facing said central upright on the side of said intermediate bar piece, said paired blocks being adapted to come into engagement with said other ends of said paired pushers when said slide plates slide away from each other.

* * * * *